US005636532A

United States Patent [19]

Shima et al.

[11] Patent Number: 5,636,532

[45] Date of Patent: Jun. 10, 1997

[54] FLAT KNITTING MACHINE HAVING ALTERNATING CONFIGURATION

[75] Inventors: Masahiro Shima; Minoru Sonomura, both of Wakayama, Japan

[73] Assignee: Shima Seiki Mfg., Ltd., Wakayama-ken, Japan

[21] Appl. No.: 401,149

[22] Filed: Mar. 9, 1995

[30] Foreign Application Priority Data

Mar. 17, 1994 [JP] Japan ..... 6-072718

[51] Int. Cl.[6] ..... D04B 7/04

[52] U.S. Cl. ..... 66/64; 66/60 R; 66/109

[58] Field of Search ..... 66/60 R, 64, 62, 66/69, 109, 116, 120, 121, 148

[56] References Cited

U.S. PATENT DOCUMENTS

| | | | |
|---|---|---|---|
| 3,584,481 | 6/1971 | Hayashi | 66/120 |
| 4,400,952 | 8/1983 | Koike et al. | 66/166 |
| 4,612,786 | 9/1986 | Perotti | 66/121 |
| 4,637,227 | 1/1987 | Shima | 66/120 |
| 5,398,527 | 3/1995 | Hirai et al. | 66/64 |

FOREIGN PATENT DOCUMENTS

| | | |
|---|---|---|
| 375656 | 12/1991 | Japan . |
| 415301 | 3/1992 | Japan . |
| 2183264 | 6/1987 | United Kingdom . |

*Primary Examiner*—C. D. Crowder
*Assistant Examiner*—Larry D. Worrell, Jr.
*Attorney, Agent, or Firm*—Loeb & Loeb LLP

[57] ABSTRACT

A pair of needle beds are provided with head portions thereof opposed to each other and a plurality of sinkers are provided in a juxtaposed relationship at the top portions of the needle beds, and first and second needles each having a transfer element are provided for sliding movement between each adjacent ones of the sinkers. The first and second needles are either provided alternately in a spaced relationship by an equal distance from each other throughout each needle bed or individually provided in an equally spaced relationship from each other but such that the distance between the first and second needles positioned on the opposite sides of each of the sinker plates is different from the other distance.

12 Claims, 5 Drawing Sheets

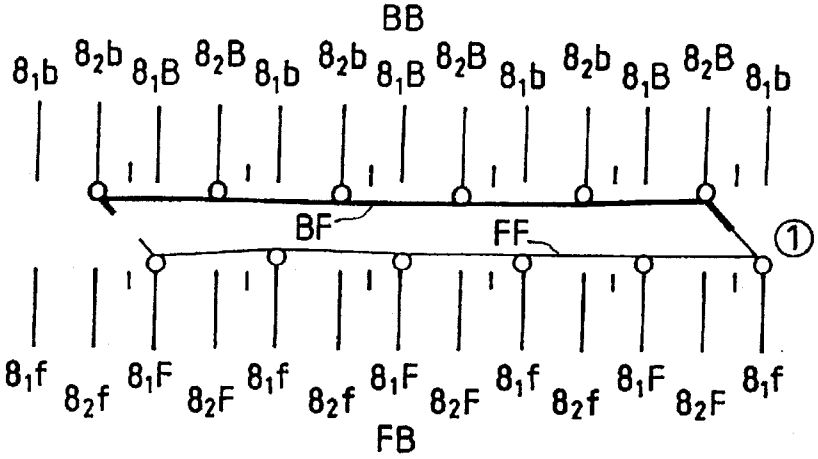
FIG. 5A
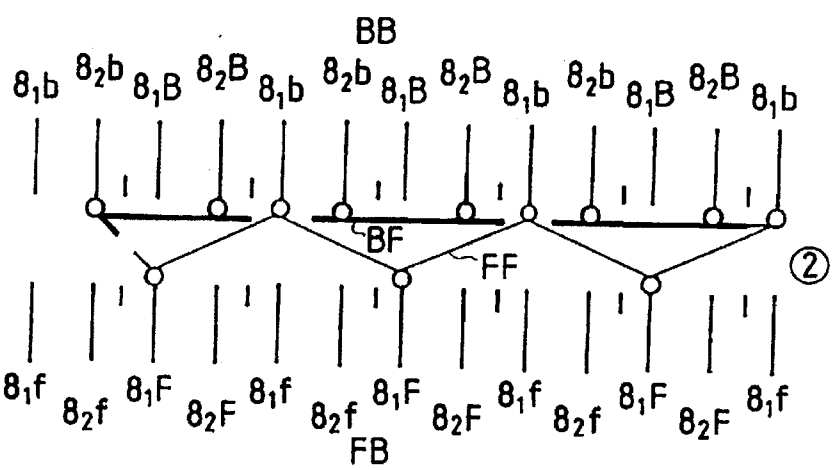
FIG. 5B
FIG. 5C
FIG. 5D

FLAT KNITTING MACHINE HAVING ALTERNATING CONFIGURATION

BACKGROUND OF THE INVENTION

1. Field of the Invention

This invention relates to a flat knitting machine.

2. Prior Art

A method of knitting a piece of non-sewn clothes utilizing a flat knitting machine is disclosed wherein, using at least one pair of needle bed having head portions opposed to each other, loops of a knitted fabric are suitably transferred between the opposed needle beds to form the body, the sleeves and other parts into a unitary fabric. (The official gazette of Japanese Patent Publication Application No. Heisei 3-75656, the specification of British Patent No. 2,183,264, the official gazette of Japanese Patent Publication Application No. Heisei 4-15301).

It is disclosed in the official gazette of Japanese Patent Publication Application No. Heisei 3-75656 or the specification of British Patent No. 2,183,264 mentioned above that, in order to knit a tubular knit fabric of an arbitrary links and links pattern including a rib stitch, a purl stitch, a links and links stitch and so forth using a well known type of V-bed knitting machine, needles provided in a juxtaposed relationship on the needle beds are used in a divided condition such that, for example, odd-numbered ones of them are used to knit a front portion of a tubular knit fabric while even-numbered ones of them are used to knit a back portion of the tubular knit fabric. For example, in order to knit a front portion of a tubular knit fabric of a wide rib stitch, such preparations for knitting of the front portion of the tubular knit fabric as to transfer those of loops of the front portion of the tubular knit fabric carried on the needles on the front needle bed which are to be formed as purl stitches in the current course to the back needle bed in accordance with a design pattern are completed first, and then knitting of the front portion of the tubular knit fabric for the current course is performed. Thereafter, prior to knitting of a back portion of the tubular knit fabric, loops of the front portion of the tubular knit fabric knitted on the back needle bed are transferred back to the front needle bed, and those of loops which are to be formed as purl stitches of the back portion of the tubular knit fabric in the current course are transferred to the corresponding needles of the front needle bed in accordance with the design pattern in a similar manner as with the front portion of the tubular knit fabric, whereafter knitting of the back portion of the tubular knit fabric is performed. The sequence of operations described above is repeated to form a tubular knit fabric.

The official gazette of Japanese Patent Publication Application No. Heisei 4-15301 discloses two embodiments for knitting a tubular knit fabric: one of the embodiments is directed to a knitting method for a tubular sweater of a pullover of a Raglan sleeve type using a so-called "four-bed flat knitting machine" wherein a pair of upper beds and a pair of lower beds are provided in pair on the front and the back; and the other embodiment is directed to another knitting method for a tubular sweater of a pullover of a set-in sleeve type wherein the tubular sweater is knitted by classifying needles on a flat knitting machine which includes a pair of front and back needle beds.

In knitting using a flat knitting machine which includes a pair of front and back needle beds such as the knitting method just described, since a tubular knit fabric is knitted using only selected ones of the needles of the opposed needle beds without modifying the structure of the needle beds themselves, the distance between adjacent needle loops on a needle bed becomes larger than the distance between adjacent needles on the needle bed, and consequently, the size of a knitted sinker loop becomes extremely greater than the size of a needle loop. This results not only in degradation of the feeling of the knit fabric, but also in degradation of the elastic property, particularly the elastic property in a lateral direction, which is the most significant characteristic of a knit fabric. For example, with a needle bed of the 7 gauge, the distance between adjacent needles is 3.628 mm, but if alternate ones of the needles are used, then the distance between adjacent used needles is 7.257 mm. When a plain stitch is knitted, two sinkers are present between adjacent loops, which further increases the length of a sinker loop between the needle loops and further deteriorates the knitting conditions.

SUMMARY OF THE INVENTION

In view of the foregoing, it is an object of the present invention to provide a flat knitting machine wherein sinker loops do not have a large size when a knit fabric is knitted using a pair of opposed needle beds under the condition that inoperative needles are present while the needle beds are used solely or simultaneously so that the flat knitting machine can knit a knit fabric of a high quality which provides no inferior feedling.

A pair of needle beds are provided with head portions thereof opposed to each other and a plurality of sinkers are provided in a juxtaposed relationship at the top portions of the needle beds, and first and second needles each having a blade, a recess, a slider or the like as a transfer element are provided for sliding movement in a common needle groove or in different needle grooves between each adjacent ones of the sinkers. The sinkers are provided in a spaced relationship from each other by a distance corresponding to a predetermined gauge value. The first and second needles are either provided alternately in a spaced relationship by an equal distance from each other throughout each needle bed or individually provided in an equally spaced relationship from each other between the sinkers but such that the distance between the needle and a needle positioned on the opposite sides of each of the sinker plates is different from the distance between the first and second needles. Further, the ratio between the distance between the needle grooves of the first and second needles positioned between each adjacent ones of the sinker needles and the distance between one of the first and second needles and a needle positioned adjacent each other across each of the sinker plates is set to range from 1:1 to 1:2.8. The first and second needles have hooks having an equal size greater than the size of an ordinary hook with respect to the distance between each adjacent ones of the needles so that sinker loops of a knitted fabric may have a size which is substantially equal to or is not extremely larger than the size of needle loops of the knitted fabric.

According to the present invention, two needles are provided between each adjacent ones of the plurality of sinkers provided in a juxtaposed relationship at the head portions of the needle beds. In order to knit a tubular knit fabric having a links and links pattern, knit stitches are knitted on the front needle bed while purl stitches are knitted on the back needle bed, and accordingly, loops of a wale are transferred between the front and back needle beds. Besides, in order to knit a front fabric and a back fabric on the needle beds in pair, those needles to knit knit stitches and those needles to knit purl stitches on each needle bed must be used in a divided condition. As a result, those needles which can be used to knit a knit stitch or a purl stitch are alternate first or second needles, and the other needles which are not used are left at their rest positions.

During knitting, when a first or second needle in an operative condition catches a knitting yarn and passes it through a needle loop of the last course to form a new needle loop, sinker loops connecting to the new needle loop are contacted with sinkers positioned on the opposite sides of the needle. However, since no sinker is provided between the needle and the second or first needle positioned between the sinkers together with the needle, forward projection of the yarn by a sinker in the proximity of the operative needle is not caused, and consequently, an increase in size of the sinker loop as much is prevented. The difference in size between the sinker loop and the needle loop is reduced also by the fact that the size of the needle loop is increased by forming the hooks of the first and second needles in a larger size.

The sinkers provided on the needle beds have a distance corresponding to the predetermined gauge value, and the first and second needles are inserted between the sinkers. When a cardigan rib stitch is knitted on a tubular fabric, every other needles are used for knitting of a course. Accordingly, by inserting, between the sinkers, needles in a needle density twice the needle density corresponding to the predetermined gauge, a knit fabric having a number of wales equal to the number of wales in the predetermined gauge can be knitted.

BRIEF DESCRIPTION OF THE DRAWINGS

FIGS. 3A and 3B shows a needle having a blade; FIG. 3C shows a needle having a recessed portion; and FIG. 3D shows a needle having a slider.

FIGS. 5A, 5B, 5C and 5D are plan views illustrating the relationship between needles and a knitting yarn and illustrating a knitting process of a 1×1 rib stitch.

DETAILED DESCRIPTION OF PREFERRED EMBODIMENT

An embodiment of the present invention will be described below with reference to the drawings.

Figure 1A:
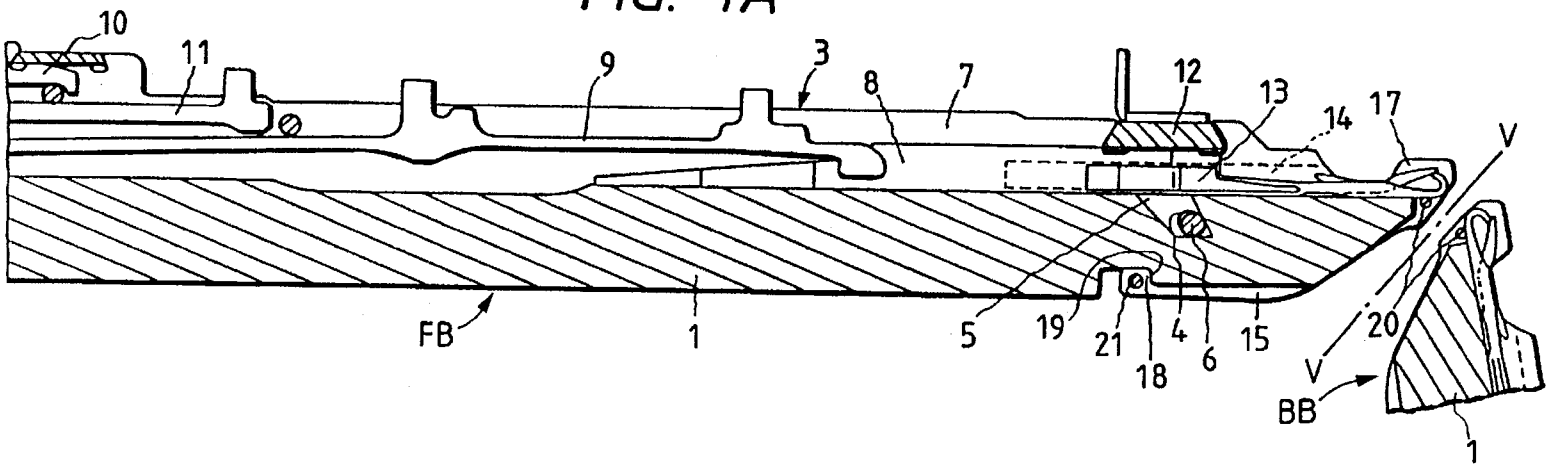
FIGS. 1A and 1B are sectional views of needle beds of a flat knitting machine of the present invention.
Figure 1B:
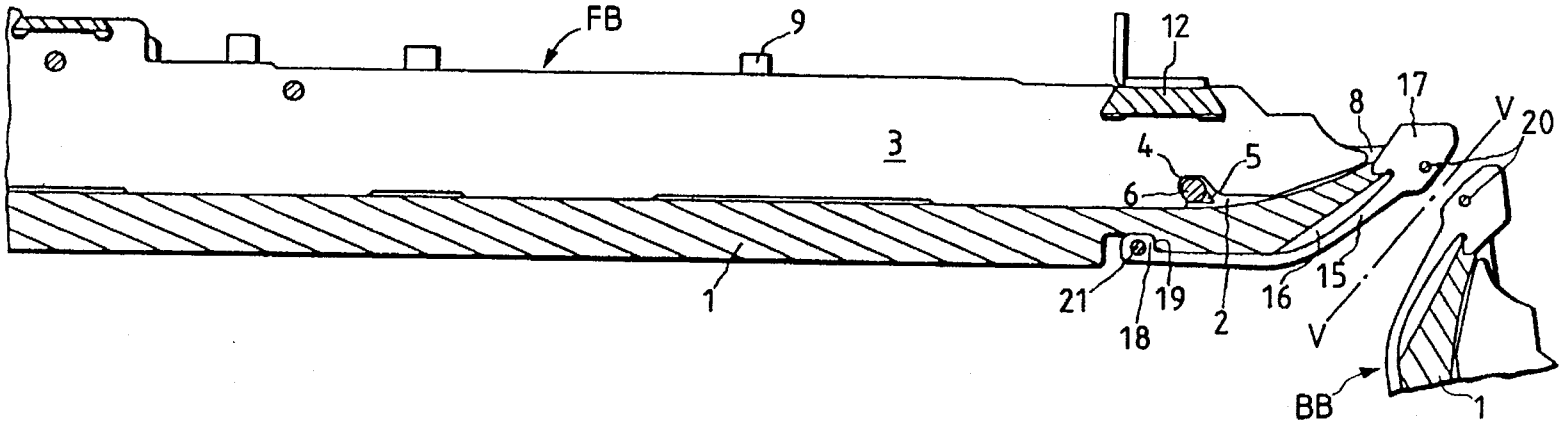
Figure 2:
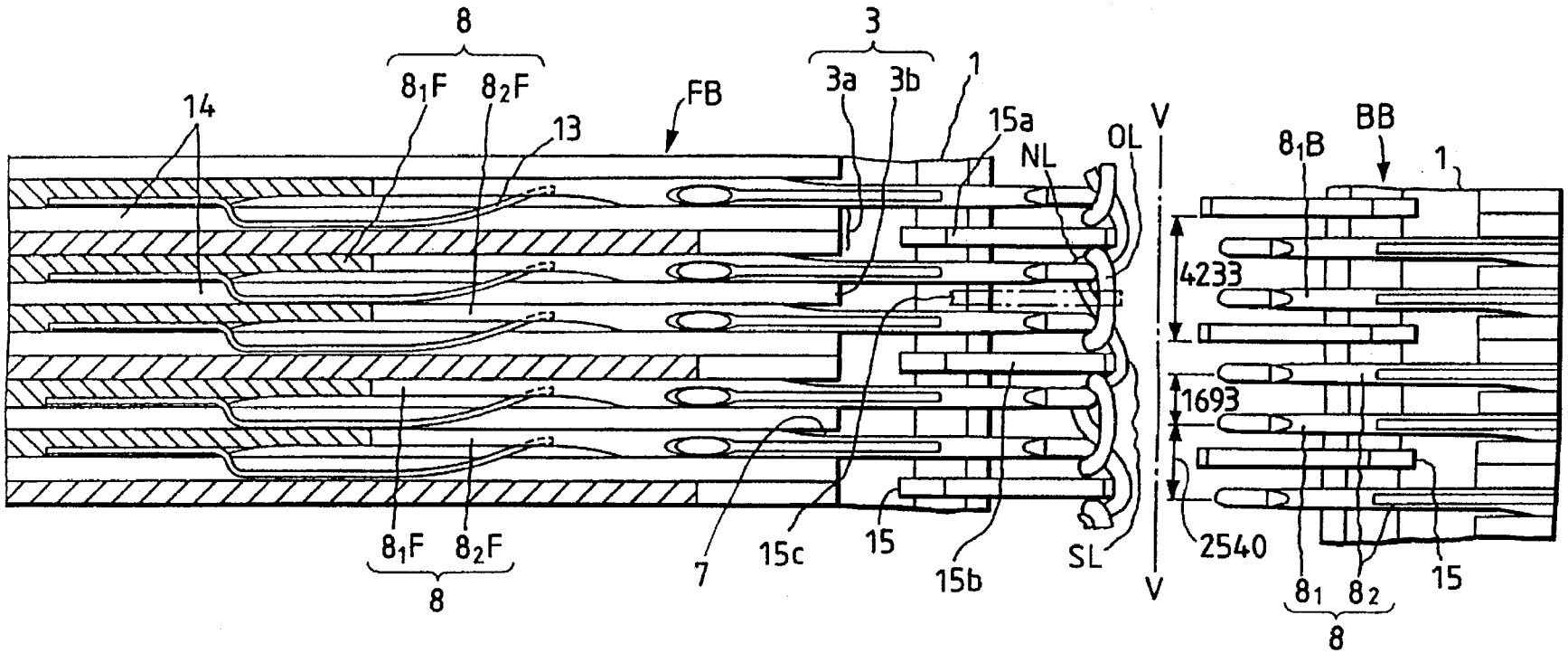
FIG. 2 is an enlarged plan view of head portions of the needle beds of the flat knitting machine of the present invention.
Figure 3A:
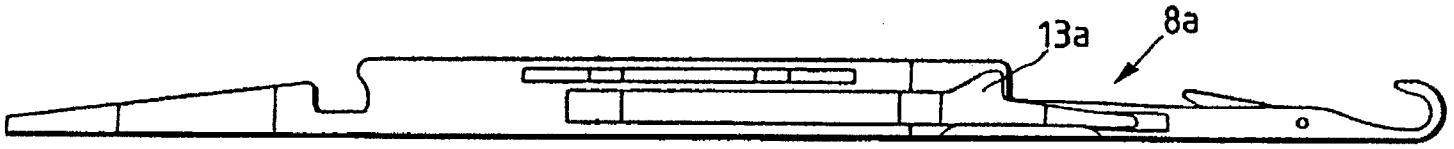
FIG. 3A–3D show needles which can be used with the flat knitting machine of the present invention.
Figure 3B:
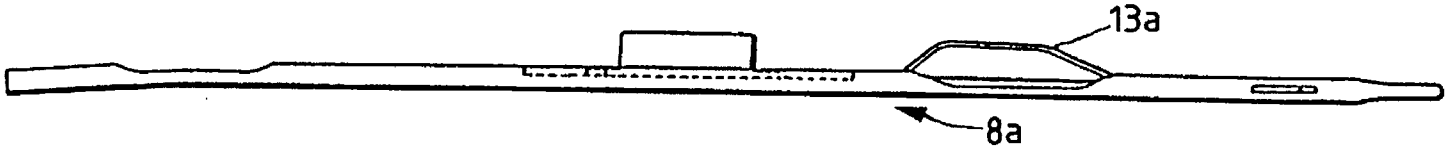
Figure 3C:
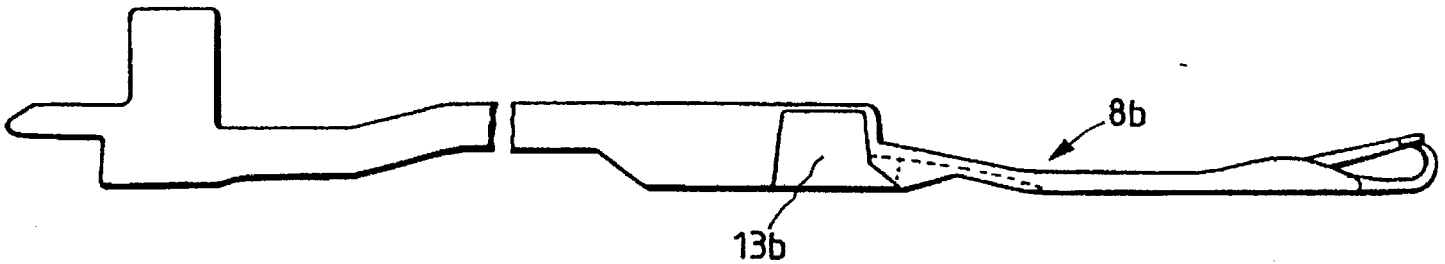
Figure 3D:
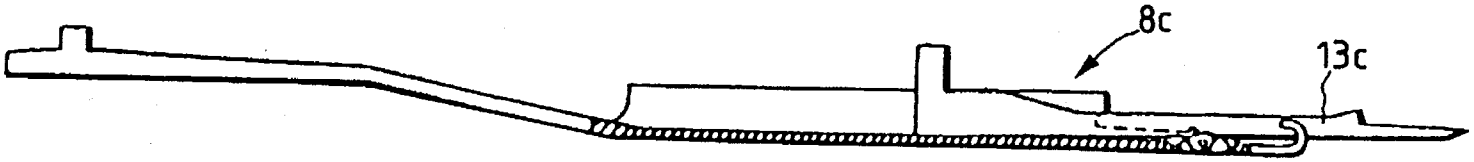

FIGS. 1A and 1B show vertical sectional views of a needle bed 1, and FIG. 2 shows an enlarged plan view partly in section. In the flat knitting machine of the present invention, two needle beds 1 are provided including a front bed FB and a back bed BB disposed on the front and the back with respect to a vertical imaginary center plane V with head portions thereof opposed to each other in a mountain-like configuration. Since the needle beds 1 of the front bed FB and the back bed BB have a same structure, the structure of the needle bed of the front bed FB will be described below.

The needle bed 1 has a plurality of parallel needle plate grooves 2 formed thereon by machining, and a needle plate 3 is inserted in each of the needle plate grooves 2. An oblique recessed portion 4 is formed on a lower face of each of the needle plate 3, and another oblique recessed portion 5 is formed on an upper face of the needle bed 1. The needle plates 3 and the needle bed 1 are arranged such that the recessed portions 4 and the recessed portion 5 are aligned with each other and a wire 6 is threaded in the thus aligned recessed portions 4 and 5 while tail portions of the needle plates 3 and the needle bed 1 are caulked to each other to secure the needle plates 3 and the needle bed 1 to each other. The needle plates 3 include needle plates **3*a* of a greater thickness and needle plates 3*b* of a smaller thickness arranged alternately with each other. Thus, a needle groove 7 is formed between each adjacent one of the needle plate 3, and a needle 8, a needle jack 9 for operating the needle 8, a selector 10 and a select jack 11 are inserted for sliding movement in each of the needle grooves 7**.

The needles 8 are prevented from coming off the needle grooves 7 by a band 12 fitted in the needle plates 3 in a direction perpendicular to the needle grooves 7. A transfer needle having a transfer element 13 provided thereon is employed for the needles 8. Examples of the needles 8 having such transfer element 13 are shown in FIG. 3. The needle **8*a* shown in A of FIGS. 3A and 3B has an arch-shaped blade 13*a* projecting on a side face of the body of the needle; the needle 8*b* shown in FIG. 3C has a recessed portion 13*b* provided on a side face of the body of the needle; and the needle 8*c* shown in FIG. 3D has a slider 13*c* provided at an upper portion of the body of the needle for sliding movement relative to the body of the needle. In the needle 8a having the blade 13*a* projecting on a side face thereof like the needle 8*a* shown in FIGS. 3A and 3B, the transfer element 13 may be provided on any of the right side face and the left side face of the body of the needle. Each of the needle plates 3 has a blade accommodating groove 14 formed therein by machining so that a blade 13*a* may not contact with the needle plate 3, and particularly in the needle plates 3*b* having a smaller thickness, the blade accommodating groove 14 extends from one side to the other side of the needle plate 3*b***.

Figure 4A:
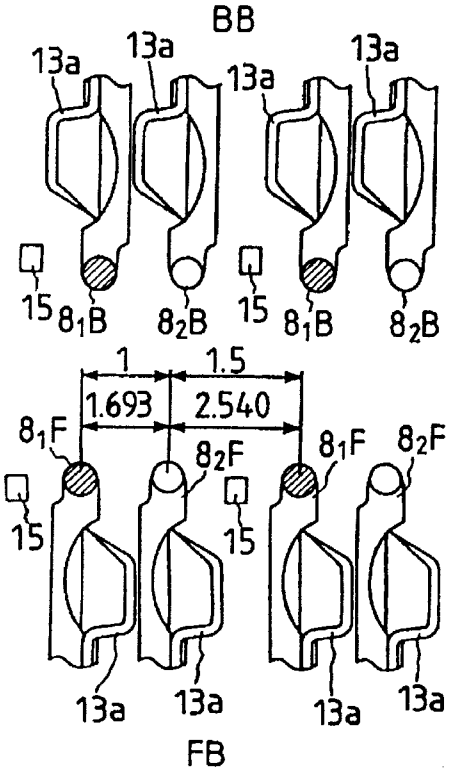
FIGS. 4A, 4B and 4C are schematic views of the head portions of the opposed needle beds illustrating the positions of blades of needles inserted between sinkers.
Figure 4B:
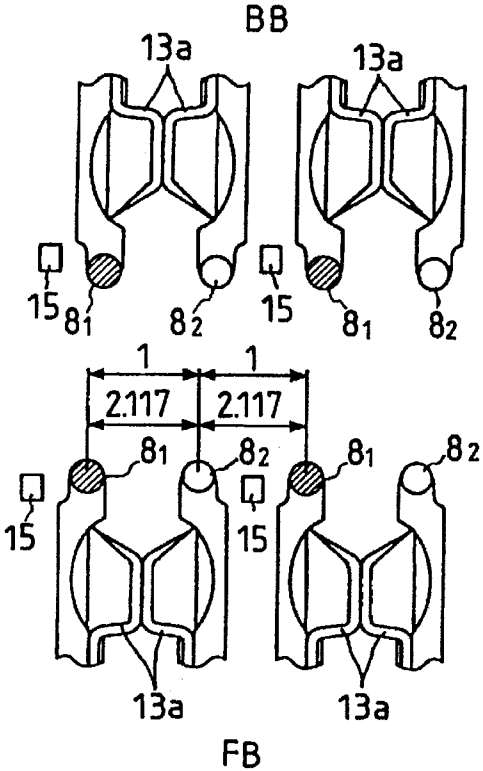
Figure 4C:
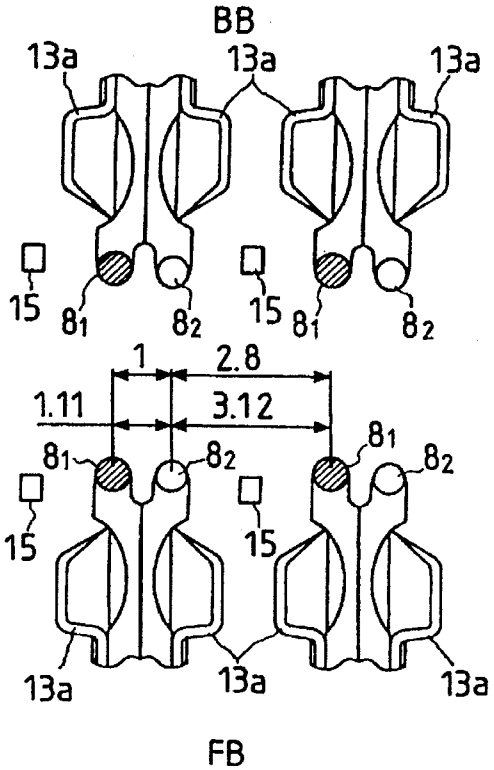

The blades **13*a* may be provided in at least three different positions. As shown in FIG. 4A, the blades 13*a* may be provided on the same side (the right side or the left side) of the bodies of all of the needles. As shown in FIG. 4B, the blades 13*a* may be provided on opposite sides (one right side and one left side) of two needles which are located between two adjacent sinker plates 15, so that the blades 13*a* face one another. As shown in FIG. 4C, the blades 13*a* may be provided on opposite sides (one right side and one left side) of two needles which are located between two adjacent sinker plates 15, so that the blades face away from one another (in a manner opposite to that illustrated in FIG. 4B). In the embodiments shown in FIG. 4**, grooves for mounting a first needle and a second needle (which will be hereinafter described) can be constructed as a single needle groove. It may be necessary to provide a spacer or a similar element between two such needles, as described above, to prevent interference between the needles so that an advancing or retracting movement of one needle will no negatively affect the adjacent needle.

As shown in FIGS. 1A and 1B a plurality of sinker plate fitting grooves 16 are provided in parallel to each other on a lower face at an end portion of an acute angle of the needle bed 1, and a sinker plate 15 formed from a plate member having a substantially obtuse-angled L-shaped side profile is fitted in each of the sinker plate fitting grooves 16. The sinker plate 15 has, at an end portion thereof, a rectangular portion 17 partially arrested on the needle bed 1 and further has, at a base portion thereof, a hook 18 arrested in a recessed portion 19 formed on the lower face of the needle bed 1 thereby to fix the sinker plate 15 to the needle bed 1. Reference numerals 20 and 21 denote wires threaded through the sinker plates 15, and the wire 20 acts as a loop holding wire to hold loops of a knitted fabric depending from a knock over edge of the needle bed 1 and provides a knock over timing.

It is a matter of course that the sinker plates need not necessarily be fixed as described above but may be plate members which are provided at an end portion of the needle bed for forward and backward movement or pivotal movement toward and away from the knock over edge of the needle bed.

The sinker plates 15 are provided one for each two needles as shown in FIG. 2. Two needles located between two adjacent sinker plates 15, 15 are hereinafter referred to as first needle 81 and second needle $8_2$. In the example shown in FIG. 2, the distance between two needle grooves, that is, two needles, positioned on the opposite sides of each sinker plate 15 is 2.540 mm, which is larger than the distance of 1.693 mm between two adjacent needles. However, all of the needle grooves may otherwise be provided in an equidistantly spaced relationship from each other.

FIG. 4 shows several examples of how needles and sinkers may be arranged in a knitting machine corresponding to a 6 gauge machine. In a usual 6 gauge knitting machine, knitting a fabric using every other needle, three needles per unit inch are used. Consequently, the distance between the needles is substantially equal to the distance between the needles in a 3 gauge knitting machine. Thus, in order to raise the needle density, twelve needles may be provided in a knitting machine which corresponds to a 6 gauge machine. In the case of FIG. 4A, it can be seen that needles used are thinner than needles for use with a knitting machine of the 6 gauge, and therefore, the distance between first and second needles is set equal to that of a knitting machine of the 15 gauge (1.693 mm); the distance between one of the first and second needles and a needle positioned across a sinker is set equal to that of a knitting machine of the 10 gauge (2.540 mm); and the distance between sinkers is set equal to that of a knitting machine of the 6 gauge (4.233 mm) which is equal to the distance between first needles or second needles. Further, the hook size of needles mounted is equal to that of a knitting machine of, for example, the 7 gauge so that the balance between sinker loops and needle loops of a knitted fabric may not be degraded very much. In FIG. 4A, the rate between the distance between two needles positioned between two sinkers and the distance between two adjacent needles across a sinker is 1:1.5. Similarly, the rate in the example of FIG. 4B is 1:1, and the rate in the example of FIG. 4C is 1:2.8.

Preferably, the rate between the distance between two needles positioned between two sinkers and the distance between two adjacent needles across a sinker ranges from 1:1 to 1:2.8. In particular, where the distance between two adjacent needles across a sinker is smaller than the distance between two needles positioned between two sinkers, the sinkers and the needles are located so near that, when a sinker loop is pulled by a pair of needles positioned on the opposite sides of and contacting with the sinker, the loop is bent very strongly between end edges of the sinker and the hooks of the needles, which makes a cause of a yarn break or some other trouble. On the contrary, where the distance between two adjacent needles across a sinker is greater than the 2.8 times distance between two needles positioned between two sinkers, the length of a sinker loop becomes excessively great. As a result, the resulted knit fabric has a deteriorated feeling with irregular stitches.

A method of knitting a knit fabric using the knitting machine of the present invention will be described below.

The knitting machine of the present invention sometimes takes, when a knitting yarn is supplied to the opposed needles of the pair of needle beds with the head portions thereof opposed to each other to knit a fabric, knitting means of temporarily transferring loops carried on needles on one of the needle beds to needles of the opposed needle bed so that all loops may be carried on the needles of one of the needle beds.

It is assumed that, for example, a tubular 1×1 rib stitch is knitted on the flat knitting machine of the present invention wherein the first needles $8_1$ and the second needles $8_2$ of the front bed FB side and the back bed BB side shown in FIG. 2 and FIG. 4A are disposed between the sinker plates 15, 15. The knitting process is illustrated in FIG. 5. Since the knit fabric is a tubular fabric, a front knit fabric FF and a back knit fabric BF must be knitted separately from each other. Further, in knitting each of the front knit fabric FF and the back knit fabric BF, knit stitches and purl stitches must be knitted alternately. The knitting means will be described below.

In order to knit a tubular 1×1 rib stitch, loops must be formed using needles on the front bed FB and the back bed BB alternately for each wale so that knit stitches and purl stitches may appear on every other wales on both of the front knit fabric FF and the back knit fabric BF. It is assumed now that, as shown in of FIG. 5A, the front knit fabric FF is carried on needles $8_1$F, $8_1$f, $8_1$F, $8_1$f, . . . of the front bed FB while the back knit fabric BF is carried on needles $8_2$B, $8_2$b, $8_2$B, $8_2$b, . . . of the back bed BB such that the front and back knit fabrics FF and BF depend in a tubular form between the front bed FB and the back bed BB. First, knitting of the front knit fabric FF from this condition will be described.

Those of loops of the last course of the front knit fabric FF which are carried on the needles $8_1$f by which purl stitches are to be formed as viewed from the front knit fabric FF side are transferred to the needles $8_1$b of the back bed BB (FIG. 5B). Then, the front knit fabric FF is knitted using the first needles $8_1$F of the front bed FB and the first needles $8_1$b of the back bed BB, and those loops carried on the needles $8_1$b of the back bed BB are transferred back to the first needles $8_1$f of the front bed FB (FIG. 5C). Thereafter, knitting of the back knit fabric BF is started. Those of loops carried on the needles $8_2$b by which purl stitches are to be formed as viewed from the back knit fabric BF side are transferred to the second needles $8_2$f of the front bed FB (FIG. 5D). Then, the back knit fabric BF is knitted using the second needles $8_2$f of the front bed FB and the second needles $8_2$B of the back bed BB, and those loops carried on the second needles $8_2$B of the front bed FB are transferred back to the second needles $8_2$b of the back bed BB (FIG. 5A). Thereafter, the knitting procedure described above is repeated.

Since the knitting procedure described above is performed in the sequence of transferring of loops, knitting and transferring of loops, for example, where such a needle arrangement as shown in FIG. 4A is employed, all processes for knitting stitches can be completed, using a carriage having three cam locks, by one stroke of the carriage if, after the back knit fabric BF is knitted, transfer of purl loops of the back knit fabric BF from the positions of FIG. 5D to the positions of FIG. 5A and transfer of purl loops of the front knit fabric FF from the positions of FIG. 5A to the positions of FIG. 5B are performed simultaneously by the first cam and a loop forming operation is performed by the second cam, and then transfer of purl loops of the front knit fabric FF from the positions of FIG. 5B to the positions of FIG. 5C and transfer of purl loops of the back knit fabric BF from the positions of FIG. 5C to the positions of FIG. 5D are performed by the third cam.

In the flat knitting machine of the present invention, while two first and second needles $8_1$ and $8_2$ are provided between two sinker plates 15, 15, only one of the first needle $8_1$ and the second needle $8_2$ performs a loop forming operation, and a knitting yarn carried on the hook of the needle which is performing a loop forming operation contacts only with the sinker plates 15, 15 positioned on the opposite sides of the needle but does not contact with the other needle which is at a rest position and is not performing a loop forming operation.

The relationship between the needles $8_1$ and $8_2$ and new and old loops NL and OL in the knitting procedure described above will be described with reference to FIG. 2. When a knitting yarn is supplied to a first needle $8_1$F of the front bed FB shown in FIG. 2 and then the needle $8_1$F is lowered so that the knitting yarn carried on the hook of the needle $8_1$F is passed through the old loop OL to make a new loop NL, the new land NL extends between two sinkers 15*a* and 15*b* between which the first needle $8_1$F and the second $8_2$F paired with each other are positioned. Consequently, the knitting yarn, which otherwise forms, on a conventional apparatus, a sinker loop bent at an acute angle by the sinker 15*a* and another sinker 15*c* which is positioned between the first and second needles $8_1$F and $8_2$F and indicated by an alternate long and short dash line in FIG. 2, is, with the flat knitting machine of the present invention, free from such a bent portion but extends straightforwardly between the sinker 15*b* and the needle $8_1$F, which prevents the sinker loop SL from becoming excessively long. Similarly by a needle $8_1$B of the back bed, a sinker loop is not increased in size.

The flat knitting machine of the present invention has such effects as listed below.

In the flat knitting machine of the present invention, since the needles and the sinker plates are provided alternately such that one sinker plate is provided for each two first and second needles, when, during knitting which is performed using only odd-numbered ones or even-numbered ones of the needles, a needle loop is retracted by a needle, a sinker loop connecting from the needle loop to another needle loop of another adjacent needle which is in a knitting operation is contacted only with one sinker plate, as different from a conventional knitting machine wherein a sinker loop which connects between adjacent operative needles when the needles are retracted during knitting which is performed using every other needles is contacted with two sinker plates. Accordingly, with the flat knitting machine of the present invention, the length of sinker loops can be reduced, and the ratio between needle loops and sinker loops will not be deteriorated. Further, since, when a sinker loop is formed, it is not extended excessively by a sinker, a knitted fabric having elasticity can be obtained.

Where each of the first and second needles provided between each adjacent ones of the sinkers is inserted in an individually peculiar needle groove, the first and second needles can be provided in a suitably spaced relationship from each other without interfering with each other.

Where the first and second needles provided between each adjacent one of the sinkers are inserted in a single common needle trick, the two needles can be located in the proximity of each other, and the needle density can be increased, which is advantageous for manufacture of a knitting machine of a fine gauge. Further, both of the first and second needles can be located nearer to the center between the two sinker plates.

Where a number of needles equal to twice an ordinary number of needles corresponding to a gauge value representing the number of needles per one inch are mounted, even if knitting is performed using every other needles on one of the two needle beds from the necessity of a loop transferring operation to the other opposed needle bed, a knit fabric can be knitted without decreasing the number of wales of the knit fabric with respect to the predetermined gauge value.

Where the first and second needles have hooks having an equal size greater than the size of an ordinary hook with respect to the distance between each adjacent ones of the needles, the balance between sinker loops and needle loops can be maintained good.

What is claimed is:

1. A flat knitting machine comprising:

a pair of needle beds having opposed head portions, a plurality of sinkers provided at the head portions of the needle beds, a plurality of needles inserted in needle grooves provided on the needle beds for slidable advancing and retracting movement, the plurality of needles comprising a first needle and a second needle, the first needle and the second needle being arranged so that the first needle and the second needle are adjacent each other and so that the first needle and the second needle are both positioned between two adjacent sinkers, the first needle and the second needle each having a transfer element.

2. The flat knitting machine of claim 1, wherein the needle bed is provided with a separate needle groove for each of the first needle and the second needle arranged between two adjacent sinkers.

3. The flat knitting machine of claim 1, wherein the needle bed is provided with a common needle groove for both of the first needle and the second needle arranged between two adjacent sinkers.

4. The flat knitting machine of claim 1, wherein the plurality of sinkers provided on the needle beds are mutually spaced by a distance corresponding to a predetermined gauge value of a flat knitting machine.

5. The flat knitting machine of claim 4, comprising a plurality of first needles and a plurality of second needles, wherein all adjacent needles are spaced by an equal distance.

6. The flat knitting machine of claim 4, comprising a plurality of first needles and a plurality of second needles, wherein adjacent first needles are spaced by a first distance therebetween adjacent second needles are spaced by a second distance therebetween the first distance and the second distance being equal to one another, first needles and second needles arranged between two adjacent sinkers are spaced by a third distance therebetween, adjacent needles disposed on opposed sides of a sinker are spaced by a fourth distance therebetween, the third distance and the fourth distance being unequal to one another.

7. The flat knitting machine of claim 4, wherein the first needle and the second needle arranged between two adjacent sinkers are spaced by a first distance therebetween, adjacent needles disposed on opposed sides of a sinker are spaced by a second distance therebetween, the first distance and the second distance define a ratio, and the ratio is in a range between approximately 1:1 and 1:2.8.

8. The flat knitting machine of claim 4, wherein the first needle comprises a body having a first side and a second side, the second needle comprises a body having a first side and a second side, the transfer element for the first needle comprises a blade provided on at least one of the first side and the second side of the body of the first needle, and the transfer element for the second needle comprises a blade provided on at least one of the first side and the second side of the body of the second needle.

9. The flat knitting machine of claim 8, wherein the blade is provided on the first side of the body of the first needle and the first side of the body of the second needle.

10. The flat knitting machine of claim 8 wherein the blade is provided on the first side of the body of the first needle and on the second side of the body of the second needle.

11. The flat knitting machine of claim 4, wherein the first needle comprises a hook, the second needle comprises a hook, the hook of the first needle and the hook of the second needle are of equal size.

12. The flat knitting machine of claim 8, wherein the blade is provided on the second side of the body of the first needle and the second side of the body of the second needle.

* * * * *